US006148729A

United States Patent [19]

Smith et al.

[11] Patent Number: 6,148,729

[45] Date of Patent: Nov. 21, 2000

[54] MISSILE SEVERANCE DEVICE

[75] Inventors: David A. Smith, St. Paul; Kim L. Christianson, Maple Grove; Kelly D. McHenry, Minnetonka, all of Minn.

[73] Assignee: Alliant Techsystems Inc., Hopkins, Minn.

[21] Appl. No.: 09/067,854

[22] Filed: Apr. 27, 1998

[51] Int. Cl.[7] ..... F42B 15/38

[52] U.S. Cl. ..... 102/307; 102/378; 89/1.14

[58] Field of Search ..... 102/306, 307, 102/308, 309, 351, 378, 377; 89/1.14

[56] References Cited

U.S. PATENT DOCUMENTS

| | | | |
|---|---|---|---|
| 2,684,030 | 7/1954 | Muskat . | |
| 2,699,721 | 1/1955 | Klotz, Jr. . | |
| 3,053,182 | 9/1962 | Christopher . | |
| 3,057,295 | 10/1962 | Christopher . | |
| 3,108,540 | 10/1963 | Fletcher . | |
| 3,233,688 | 2/1966 | Bell . | |
| 3,244,104 | 4/1966 | Mills . | |
| 4,148,257 | 4/1979 | Orrill et al. | 102/24 |
| 4,354,433 | 10/1982 | Owen . | |
| 4,407,468 | 10/1983 | Bement et al. | 244/137 |
| 4,430,939 | 2/1984 | Harrold | 102/307 |
| 4,649,824 | 3/1987 | Guay | 102/307 |
| 5,098,487 | 3/1992 | Brauer . | |

*Primary Examiner*—Jack W. Lavinder
*Attorney, Agent, or Firm*—George A. Leone; Mark Goldberg

[57] ABSTRACT

A missile severance device for severing a structural surface member of a body is constructed of a pair of plate members separated by a collapsible liner member ring. An explosive charge is contained with the volume defined by the pair of plate members and the liner member ring. One of the plate members includes a booster explosive charge that serves to detonate the explosive charge so as to collapse the liner member ring and create a directed jet toward the structural surface member intended to be cut.

11 Claims, 6 Drawing Sheets

MISSILE SEVERANCE DEVICE

FIELD OF THE INVENTION

The present invention relates generally to missile severance devices, and more particularly to a severance device for severing thick-walled, small diameter missile sections.

BACKGROUND OF THE INVENTION

Explosive cutting techniques, methods, and mechanisms are commonly employed in conjunction with space vehicles having vehicle skins or shells which are generally made of aluminum or high strength-to-weight composite materials. Applications of such cutting mechanisms include, among others, missile stage separation and payload release, and missile destruction systems.

A common explosive cutting technique includes the employment of linear shaped charges as particularly shown in U.S. Pat. No. 4,430,939, entitled, "Linear Shaped Charges," issued to G. Harold. Linear shaped charges, commonly employed in missile applications, include a linear V-shaped formed charge which is clad with a light weight metallic material. The explosive physical mechanics of such V-shaped linear charges are particularly described in U.S. Pat. No. 4,649,824, entitled, "Apparatus For Aerospace Vehicle Separation Events Using A Linear Shaped Charge," issued to R. H. Guay.

Another application of a V-shaped linear shaped charge is an explosive cutting device for severing a chain as taught in U.S. Pat. No. 4,148,257, entitled, "Explosive Cutting Device," issued to Orrill, et al. Orrill, et al, teaches the employment of a V-shaped linear charge in combination with a standoff separating the notch of the V-shape charge away from the link of a chain intended to be severed. A similar standoff or separation requirement of the V-shaped charge relative to the surface member intended to be cut is well known, as is also taught in the aforesaid U.S. Pat. No. 4,649,824. The separation distance between the V-shaped charge and the surface intended to be cut is thought to allow the development of a powerful jet of liner material to be propelled toward the target.

One disadvantage of missile severance devices employing linear shaped charges is the difficulty in severing thick walls forming the skin of a missile or vehicle body having a small diameter aperture while at the same time limiting the size of the missile severance device. This is particularly true with increasing volume constraints in smaller type missiles. For example, many types of prior art missile severance devices are not useful for reliably severing missile sections having a diameter of less than about 8 inches with a skin thickness of about 0.75 inches or thicker.

Furthermore, as the size of such missile severance devices employing linear shaped charges decreases, reliability of the missile severance device also decreases.

SUMMARY OF THE INVENTION

The present invention provides a compact highly reliable missile severance device for cutting a skin of a vehicle body such as a missile. In accordance with the present invention, a liner member ring is sandwiched between a booster plate member and a cover plate member. The booster plate member contains an aperture containing a booster explosive pellet. A cutting charge, also called a cutting explosive, is contained within an enclosed chamber formed by the booster plate member, the cover plate member, and the liner member ring. The liner member ring is constructed of a pliable metallic material. The liner member ring is formed so as to have a collapsible thickness. Detonation of the booster explosive pellet detonates the cutting charge that causes the collapse of the liner member ring thereby producing an outwardly directed jet. In turn, the directed jet is capable of cutting through and severing a surface member, for example, a missile skin, proximate to the cover plate member.

In one embodiment of the invention a missile severance device includes a copper liner housed between two metal plates. A cutting explosive is cast between the plates such that the plates provide cutting energy when the device is operated. One of the plates also includes a booster explosive pellet that initiates the cutting explosive. The device advantageously employs shaped charge technology to explosively cut thick walled missile skins. The device functions when an external source, such as a missile safe and arm, supplies a detonating input to the booster explosive pellet loaded into the input plate, also called a booster plate herein. The pellet then detonates the main charge of cutting explosive, typically PBXN-110 explosive that has been cast between the input plate and the cover plate. The cutting explosive propagates outwardly, thereby collapsing the liner that is also housed between the plates. The collapse of the liner produces a shaped charge jet that stretches across a standoff to cut the missile skin.

One advantage of a missile severance device constructed in accordance with the present invention is an increased cutting capability in small diameters with an increased reliability resulting from substantially eliminating internal explosive interfaces.

It is another object of the invention to provide a missile severance device for reliably severing missile sections having a diameter of less than about 8 inches with a skin thickness of about at least 0.75 inches.

The design is also easy to manufacture and install in missiles, resulting in cost savings over conventional flexible linear shaped charge systems.

Other objects, features and advantages of the invention will become apparent to those skilled in the art through the description of the preferred embodiment, claims and drawings herein wherein like numerals refer to like elements.

DETAILED DESCRIPTION OF THE INVENTION

Figure 1:
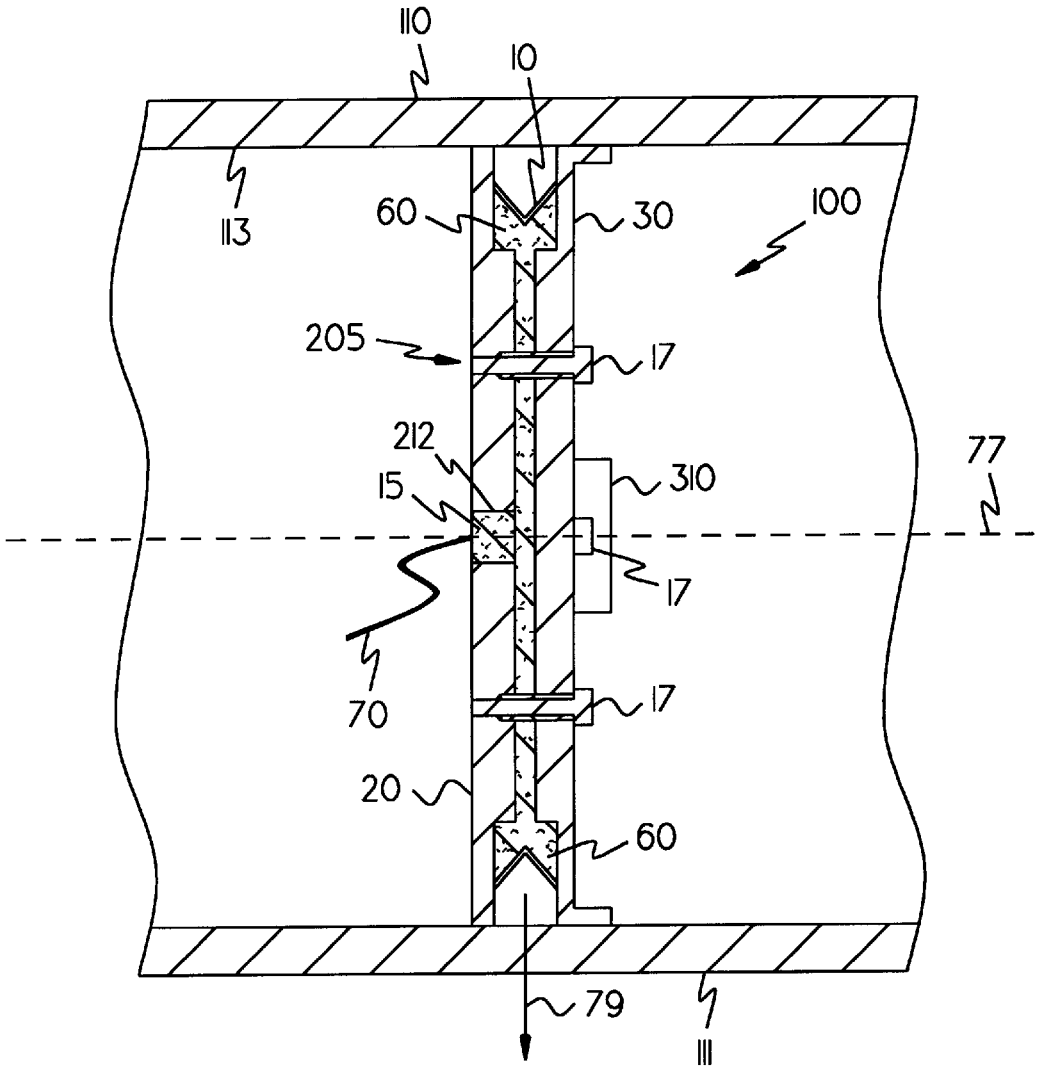
FIG. 1 is a cross-sectional view of the cutting mechanism including a booster plate member, a cover plate member and a liner member ring in accordance with the present invention.

Illustrated in FIG. 1 is a cross-sectional view of the missile severance device of the present invention generally indicated by numeral 100. It will be understood that the embodiments described herein are by way of illustration only and that the invention is not so limited. Missile severance device 100 includes a liner member ring 10 sandwiched between a booster plate member 20 and cover plate member 30. Missile severance device 100 is rigidly attached to a vehicle body 111 by means not shown so that booster plate member 20 is proximate surface skin member 110, having skin member anterior surface 113, of the vehicle body 111, where the vehicle body 111 is intended to be severed. Also shown in FIG. 1 are a booster explosive charge 15 contained within a central aperture 212, bolts 17, an explosive cutting charge 60, a detonation device 70, threaded apertures 205, and standoff members 310 all of which will be described in further detail with respect to the various views.

Figure 2C:
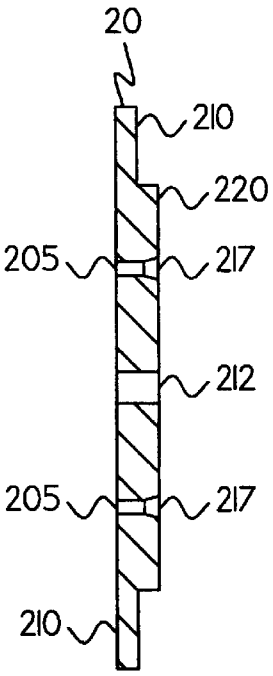
FIGS. 2A–C illustrate different views of the booster plate member of FIG. 1.
Figure 2B:
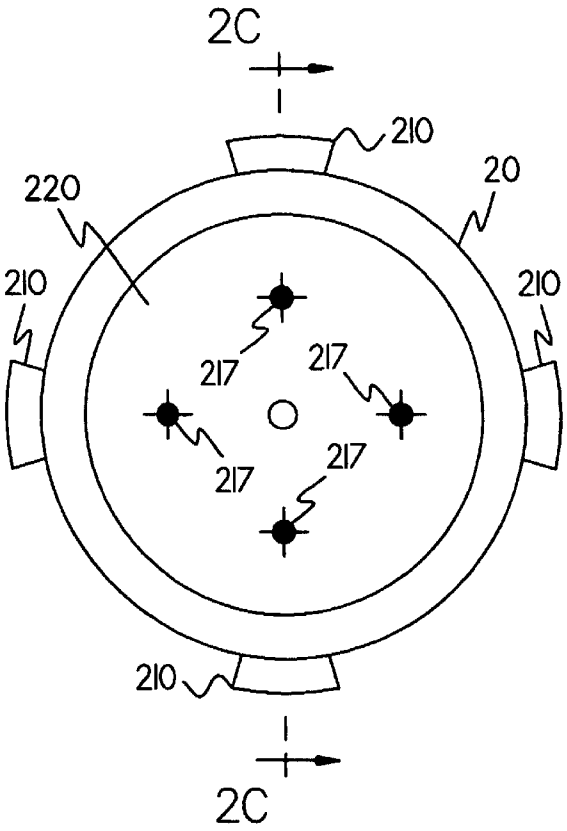
Figure 2A:
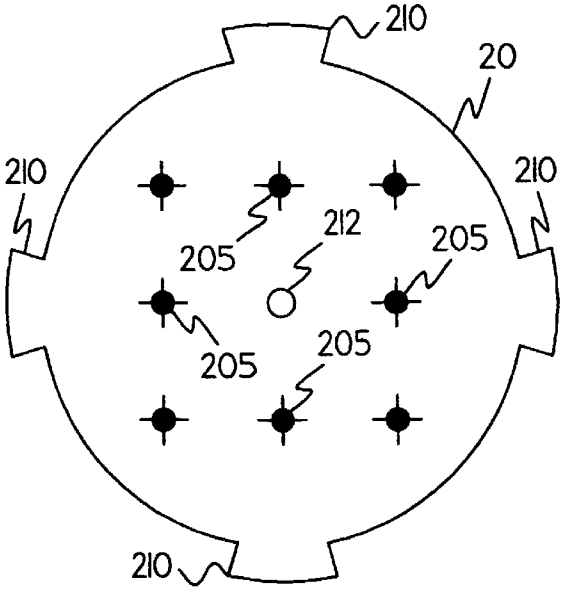

FIGS. 2A–C illustrate differing views of one example of booster plate member 20. FIG. 2A is a plan view of one side of booster plate member 20, FIG. 2B is a plan view of the opposite side of booster plate member 20 as illustrated in FIG. 2A, and FIG. 2C is a cross-sectional view along section lines 2C—2C as identified in FIG. 2B. As illustrated in FIGS. 2A–C, booster plate member 20 may advantageously be a generally ring shaped member which may include standoff tabs 210. Booster plate member 20 includes the central aperture 212 therethrough, and is intended to contain the booster explosive charge 15 as particularly illustrated in FIG. 1. Further, the booster plate member 20 includes threaded apertures 205 tended to be threadably engaged with bolts 17 as illustrated in FIG. 1. Booster plate member 20 further includes a circularly shaped protruding member 220 having counter bore apertures 217 aligned with the smaller threaded apertures 205.

Figure 3B:
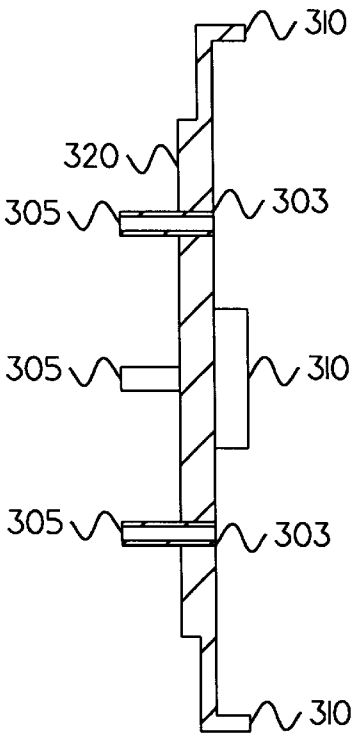
FIGS. 3A–B illustrate different views of the cover plate member of FIG. 1.
Figure 3A:
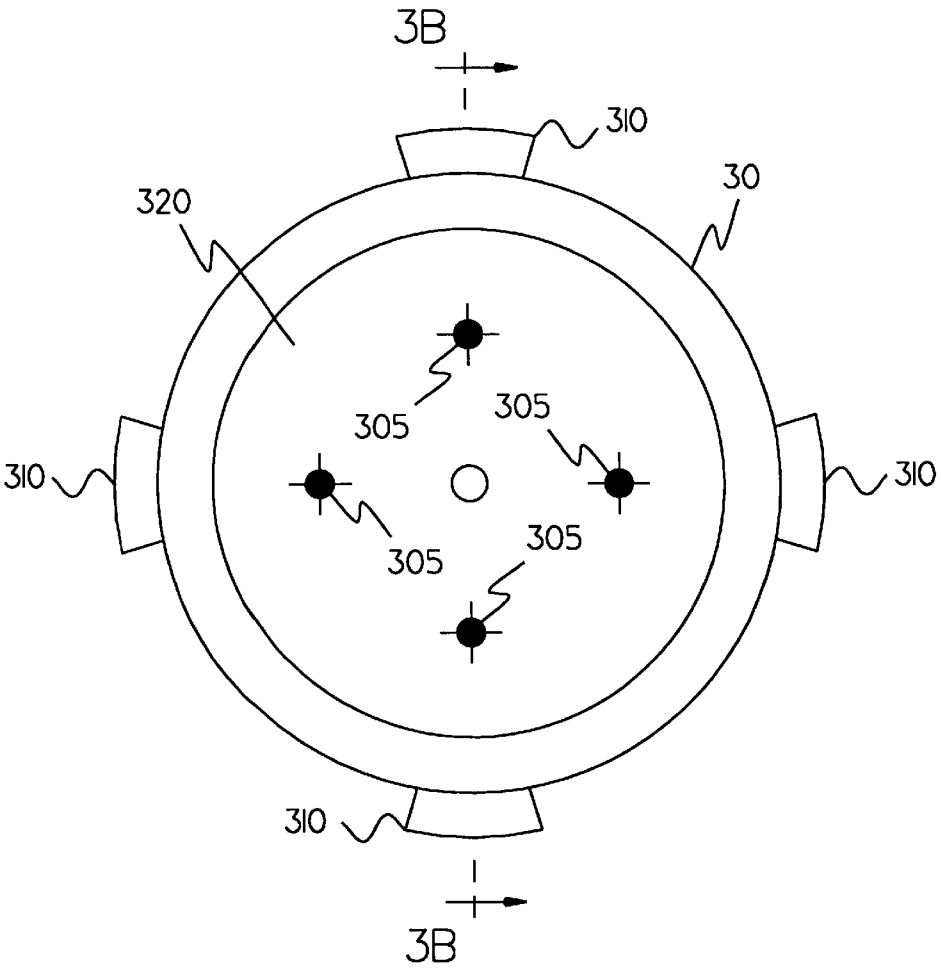

FIGS. 3A–C illustrate differing views of cover plate member 30. FIG. 3A a plan view of one side of cover plate member 30, and FIG. 3B is a cross-sectional view along section lines 3B—3B as identified in FIG. 3A. As illustrated in FIGS. 3A–B, cover plate member 30 is a generally ring shaped member which may include the formed standoff members 310 illustrated as standoff tabs. Further, cover plate member 30 includes protruding locating pins 305 press fitted into mating holes 303 of cover plate member 30 which are intended to mate with receiving counter bore apertures 217 of booster plate member 20. The locating pins are advantageously hollow to accommodate fastening bolts that hold the device together. Cover plate member 30 further includes a circularly shaped protruding member 320.

Figure 4C:
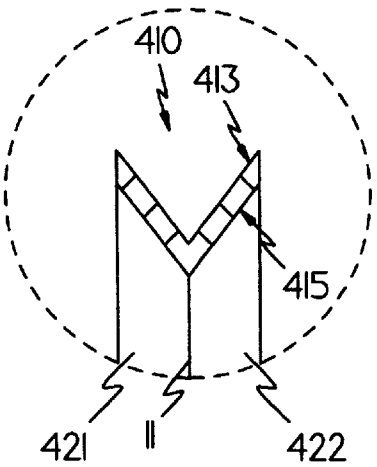
FIGS. 4A–C illustrate different views of the liner member ring of FIG. 1.
Figure 4B:
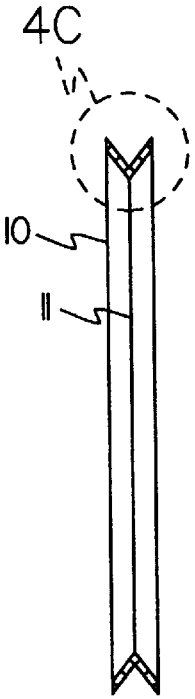
Figure 4A:
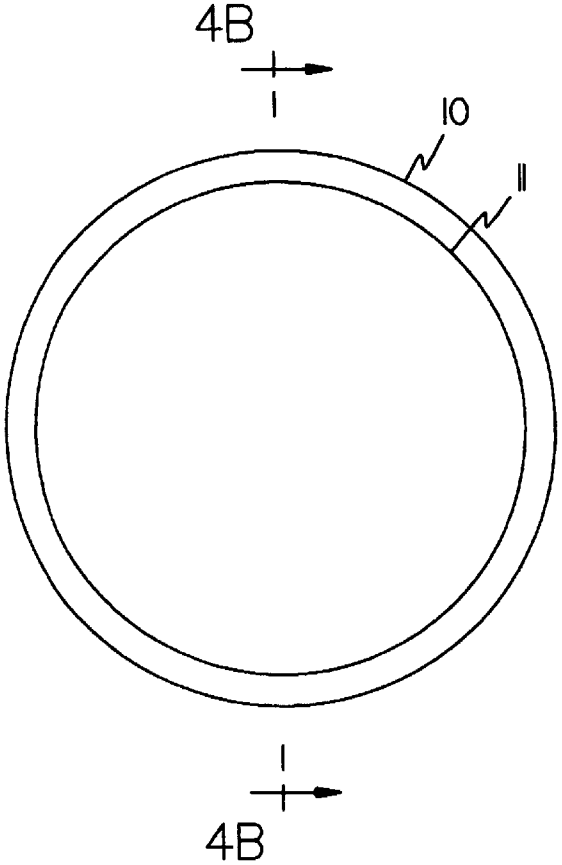
Figure 6:
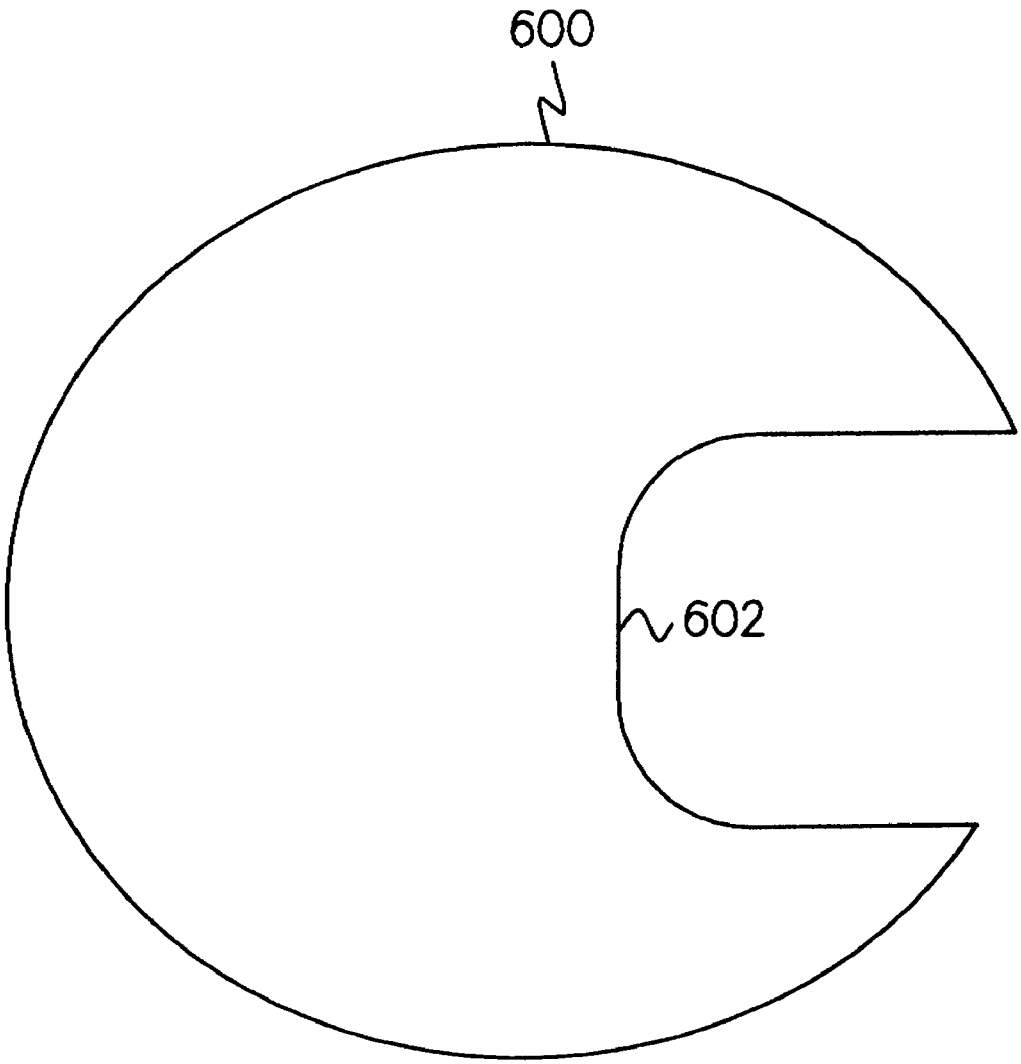
FIG. 6 illustrates an alternate configuration for the liner member ring.

FIGS. 4A–C illustrate differing views of liner member ring 10. FIG. 4A is a plan view of one side of liner member ring 10, FIG. 4B is a cross-sectional view of liner member ring 10 along section lines 4B—4B as identified in FIG. 4A. FIG. 4C is a magnified detail of the outer peripheral portion of the cross-sectional view of FIG. 4B. Liner member ring 10 is intended to be made of a pliable material such as copper that is formed so as to be collapsible in a manner as will be subsequently described. Note that while the liner member ring is shown herein as generally circular, this is by way of example only. Non-circular rings may also be used on the configuration needed to fit within a missile body. FIG. 6 shows an example of a useful configuration comprising a substantially circular ring 600 having a conduit 602 where cables or other missile components may be passed therethrough as desired.

As is particularly illustrated in the detailed cross-sectional view of FIG. 4C, liner member ring 10 is constructed so as to be substantially V-shaped with the inner edge 11 of the ring, i.e., with the apex of the of the V-shape directed radially inward, and the outer edges of the V-shaped ring forming a pair of peripheral edges 413 and 415 of the ring. When the cutting explosive is detonated, the V-shaped ring is designed to fold up or collapse as a result of explosive forces impinging on surfaces 421 and 422 of the liner member ring 10.

Referring again to FIG. 1, in accordance with the present invention, the booster plate member 20 is attached to the cover plate member 30 by way of bolts 17 with the liner member ring 10 sandwiched therebetween and with the locating pins 305 of the cover plate member engaged with counter bores 217 of booster plate member 20. The aforementioned assembly, as particularly illustrated in FIG. 1, is such that a spatial void is created within the space between the booster plate member 20 and cover plate member 30 which is peripherally bounded by the liner member ring 10. The space between booster plate member 20 and cover plate member 30 is particularly controlled by the length of locating pins 305. In the preferred embodiment of the invention, an explosive cutting charge 60, as particularly illustrated in the cross-sectional view of FIG. 1, is intended to be dimensionally cast and machined so as to be contoured to fill the aforesaid spatial void and also be sandwiched between the booster plate member 20 and cover plate member 30.

In one embodiment of the invention, the booster plate is mounted inside a vehicle body 111 by conventional means (not shown) of which skin member 110 is also a member therewith. In one example, the missile severance device of the invention is mounted within a missile substantially perpendicularly to a central longitudinal axis 77 of the missile.

In operation, the detonation device 70 is coupled to booster explosive charge 15. In one example of the invention the detonation device 70 may comprise a detonation cord or equivalent device. As will be appreciated by those skilled in the art, other known types of means for transmitting a detonation signal may also be used, such as a missile safe and arm signal. Upon receiving a detonation signal from the detonation device, the booster explosive charge 15 is detonated and, in turn, detonates the explosive cutting charge 60 which propagates radially outward so as to cause the liner member ring 10 to collapse due to explosive forces impinging against the ring surfaces 421 and 422. In turn, the collapse of the liner member ring 10 produces a directed charge jet 79 propelling generally parallel to and away from booster plate member 20 and cover plate member 30 ultimately severing the skin member 110 around the periphery of the ring formed by the missile severance device.

While it will be understood that the invention is not to be so limited, in one exemplary operable embodiment of the invention, liner member ring 10 was constructed of a copper alloy having a wall thickness of 0.050 inches, with an outer diameter of 6.340 inches and an inner diameter of 5.589 inches, and a V-shaped angle 410 of 90 degrees. Both the booster plate member 20 and the cover plate member 30 were constructed of stainless steel where the total thickness of the protruding member and plate member was 0.375 inches. The booster explosive charge 15 was provided by a PBXN-5 plastic bonded explosive pellet, and the explosive cutting charge 60 was provided by a caste and machined PBXN-110 plastic bonded explosive, both of which are well known explosive materials. PBXN-5 plastic bonded explosive, for example, comprises 95% HMX ($C_4H_8N_8O_8$) and 5% Viton A (60/40 vinylidene fluoride/hexafluoropropylene coplolymer). PBXN-110 plastic bonded explosive, for example, comprises substantially 88% HMX Type II explosive in accordance with U.S. Military Standard MIL-H-45444 and 5.365% polybutadiene or 5.365% isodecyl pelargonate, 0.7% lecithin, 0.510% isophoprone diisocyanate and lesser amounts of other known chemicals including dibutylin sulfide, 2,6-di-t-butyphenol, and ferric acetylacetonate.

It should be recognized that there are a wide range of explosive materials which may be employed for booster explosive charge 15 and explosive cutting charge 60 beyond that described herein. Further, booster plate member 20, and cover plate member 30 may also be constructed of a wide range of materials and shapes so as to provide their intended function including typical shaped charge metals like pure copper, pure aluminum, pure tantalum, silver, and pure gold. These and other variations are intended to be within the true spirit and scope of the present invention.

Figure 5C:
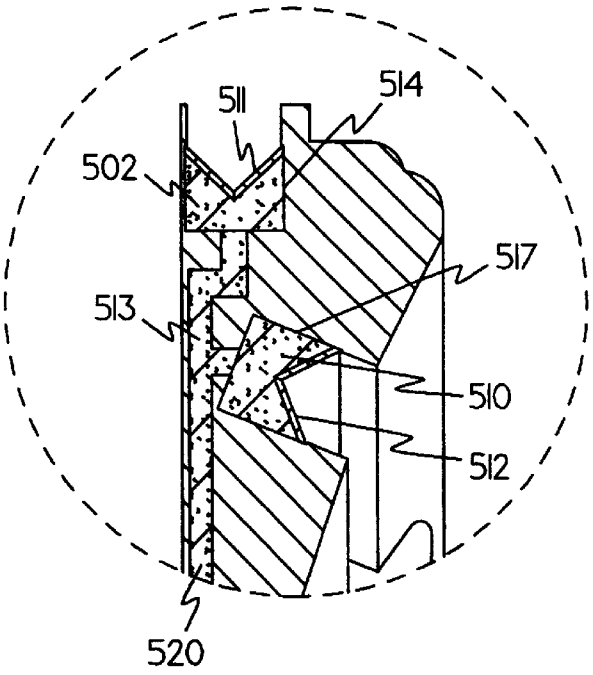
FIGS. 5A–C illustrate different views of an alternative embodiment of the cutting mechanism including a thrust termination cutting charge in accordance with the present invention.
Figure 5B:
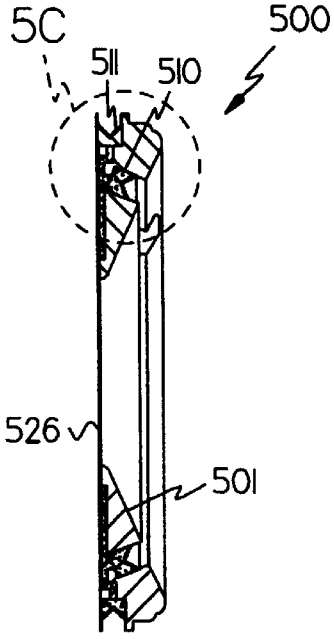
Figure 5A:
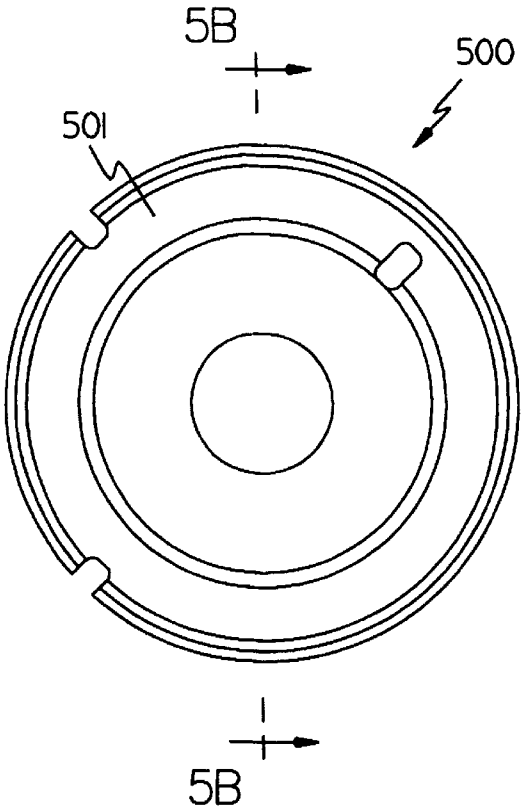

Referring now to FIGS. 5A–C different views of an alternative embodiment of the cutting mechanism including a thrust termination cutting explosive in accordance with the present invention are shown. FIG. 5A shows a missile integral cutting assembly 500. FIG. 5B shows a cross sectional view along lines 5B—5B of the missile integral cutting assembly 500. FIG. 5C shows a more detailed view of a portion of FIG. 5B.

The missile integral cutting assembly 500 includes a ring member 501 having a first channel 513 for containing a booster explosive charge 520, a second channel 514 around the periphery of the plate member for containing a missile section cutting explosive 502 and a third channel 517 for containing a thrust termination cutting explosive 510. The second and third channels 514, 517 are in communication with the first channel 513. A safe and arm interface 526 is attached to the plate member 501 and the booster explosive charge is caste between the plate member and the safe and arm interface such that the booster explosive charge is in communication with the missile section cutting explosive 502 and the thrust termination cutting explosive 510. As in the embodiment described with reference to FIG. 1, a first liner member ring 511, constructed to have a collapsible thickness, surrounds the second channel and the plate member is rigidly attached to safe and arm interface with the first liner member ring sandwiched therebetween. The missile section cutting explosive 502 is caste into the second channel bounded by the second channel, first liner member ring and safe and arm interface. The second liner member ring, encloses the third channel and the thrust termination cutting explosive 510 is thereby contained in the third channel.

In one example, the plate member is constructed from stainless steel, and the first and second liner member rings may be constructed from copper. However, as detailed above, the first and second liner member rings may consist of material selected from the group consisting of pure copper, pure aluminum, pure tantalum, silver, and pure gold.

In operation, the missile integral cutting assembly 500 may advantageously be constructed so that the missile section cutting explosive and the thrust termination cutting charge are in communication with the booster explosive charge so as to be simultaneously detonated upon detonation of said booster explosive charge. The missile section cutting explosive 502 operates to severe a missile skin such as is shown in FIG. 1. The thrust termination cutting explosive 510 is caste into the second ring 512 for simultaneously severing a rocket motor(not shown).

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different materials and structural configurations, and that various modifications, both as to materials and structural configurations and operating procedures, may be accomplished without departing from the true spirit and scope of the present invention.

The embodiments of an invention in which an exclusive property or right is claimed are defined as follows:

1. A missile severance device for circumferential severance of missile sections when mounted within a missile defined by a body having a central longitudinal axis surrounded by a missile skin, the missile severance device comprising:

a booster plate member having a generally central aperture containing a booster explosive charge therewithin, said booster plate member rigidly coupled to said missile body with said central aperture generally aligned longitudinally with said central longitudinal axis of said missile, and with peripheral edge portions thereof proximate said missile skin intended to be severed;

a cover plate member;

an explosive cutting charge sandwiched between said booster plate member and said cover plate member, and in contact with at least central portions of said booster plate member and said cover plate member;

a liner member constructed so as to have a collapsible thickness, where said liner member substantially surrounds peripheral portions of said explosive cutting charge, and extends generally between said booster plate member and said cover plate member; and means for rigidly securing said booster plate member to said cover plate member and sandwiching said explosive charge and said liner member therebetween.

2. The missile severance device of claim 1 wherein said booster plate member and cover plate member are constructed from stainless steel, and said liner member is constructed from copper.

3. The missile severance device of claim 1 wherein said liner member consists of material selected from the group consisting of copper, aluminum, tantalum, silver and gold.

4. The missile severance device of claim 1 wherein said liner member comprises a V-shape cross-section having an apex pointing radially inward.

5. The missile severance device of claim 1 further comprising:

detonation means coupled to said booster explosive charge for detonating said booster explosive charge, where the explosive cutting charge comprises plastic bonded explosive dimensionally cast and machined.

6. The missile severance device of claim 5 wherein said liner member ring consists of material selected from the group consisting of copper, aluminum, tantalum, silver, and gold.

7. The missile severance device of claim 5 wherein said liner member has a V-shape cross-section having an apex thereof directed radially inward toward said explosive cutting charge.

8. A missile severance device for circumferential severance of missile sections when mounted within a missile defined by a body having a central longitudinal axis surrounded by a missile skin, the missile severance device comprising:

a booster plate member having a generally central aperture containing a booster explosive charge therewithin, said booster plate member rigidly coupled to said missile body with said central aperture generally aligned longitudinally with said central longitudinal axis of said missile, and with peripheral edge portions thereof proximate said missile skin intended to be severed;

a cover plate member;

an explosive cutting charge sandwiched between said booster plate member and said cover plate member, and in contact with at least central portions of said booster plate member and said cover plate member;

a generally ring-shaped liner member surrounding peripheral portions of said explosive cutting charge and extending generally between said booster plate member and said cover plate member, said ring-shaped liner member having a generally V-shaped cross-section having an apex thereof directed radially inward toward said explosive cutting charge, and means for rigidly securing said booster plate member to said cover plate member and sandwiching said explosive charge and said ring-shaped liner member therebetween.

9. The missile severance device of claim 8 wherein said booster plate member and said cover plate member are constructed from stainless steel, and said liner member ring is constructed from copper based material.

10. The missile severance device of claim 8 wherein said liner member ring consists of material selected from the group consisting of copper, aluminum, tantalum, silver, and gold.

11. The missile severance device of claim 8 further comprising detonation means coupled to said booster explosive charge for detonating said booster explosive charge so as to detonate said explosive charge, and collapse said ring-shaped liner member.

* * * * *